US008226505B2

(12) United States Patent
Burger

(10) Patent No.: US 8,226,505 B2
(45) Date of Patent: Jul. 24, 2012

(54) VIBRATION DAMPENING BALL BAT

(75) Inventor: George W. Burger, Rocklin, CA (US)

(73) Assignee: Hillerich & Bradsby Co., Louisville, KY (US)

( * ) Notice: Subject to any disclaimer, the term of this patent is extended or adjusted under 35 U.S.C. 154(b) by 90 days.

(21) Appl. No.: 12/589,696

(22) Filed: Oct. 27, 2009

(65) Prior Publication Data

US 2011/0098141 A1 Apr. 28, 2011

(51) Int. Cl.
*A63B 59/06* (2006.01)

(52) U.S. Cl. ..... 473/520; 473/566; 473/567

(58) Field of Classification Search ..... 473/519, 473/520, 457, 564–568
See application file for complete search history.

(56) References Cited

U.S. PATENT DOCUMENTS

| | | | | |
|---|---|---|---|---|
| 3,877,698 | A * | 4/1975 | Volpe | 473/520 |
| 4,951,948 | A | 8/1990 | Peng | |
| 5,593,158 | A * | 1/1997 | Filice et al. | 473/520 |
| 6,511,392 | B1 * | 1/2003 | Chohan | 473/564 |
| 6,863,628 | B1 | 3/2005 | Brandt | |
| 6,929,573 | B1 | 8/2005 | Chang | |
| 7,044,871 | B2 * | 5/2006 | Sutherland et al. | 473/564 |
| 7,052,419 | B2 * | 5/2006 | Chang | 473/566 |
| 7,128,670 | B2 * | 10/2006 | Souders et al. | 473/567 |
| 7,201,679 | B2 * | 4/2007 | Nguyen | 473/520 |
| 7,311,620 | B1 * | 12/2007 | Heald et al. | 473/566 |
| 7,377,866 | B2 * | 5/2008 | Van Nguyen | 473/566 |
| 7,381,141 | B2 * | 6/2008 | Van Nguyen | 473/566 |
| 7,419,446 | B2 * | 9/2008 | Nguyen | 473/567 |
| 7,572,197 | B2 * | 8/2009 | Chauvin et al. | 473/567 |
| 7,601,083 | B1 | 10/2009 | Heald et al. | |
| 7,798,926 | B1 * | 9/2010 | Hsu | 473/566 |
| 2003/0158006 | A1 * | 8/2003 | Tribble | 473/564 |
| 2003/0186763 | A1 * | 10/2003 | Eggiman et al. | 473/564 |
| 2006/0252586 | A1 * | 11/2006 | Nguyen | 473/564 |
| 2007/0155546 | A1 * | 7/2007 | Chauvin et al. | 473/520 |
| 2007/0191156 | A1 | 8/2007 | Van Nguyen | |
| 2007/0207882 | A1 | 9/2007 | Van Nguyen | |
| 2008/0058132 | A1 | 3/2008 | Nguyen | |
| 2009/0264230 | A1 * | 10/2009 | Thouin | 473/567 |

OTHER PUBLICATIONS

International Search Report, Form PCT/ISA/210, 2 pages, for International Application No. PCT/US10/02834 completed on Dec. 9, 2010 and mailed Dec. 17, 2010.

* cited by examiner

*Primary Examiner* — Mark Graham
(74) *Attorney, Agent, or Firm* — Bingham Greenebaum Doll LLP; Brian W. Chellgren; James C. Eaves, Jr.

(57) ABSTRACT

The present invention relates to a ball bat with improved shock and vibration dampening. More particularly, the present invention relates to a ball bat with a handle, a barrel, and a socket assembly interposed between the handle and barrel. The socket assembly allows the barrel and handle to move relative to each other, which dampens shock and vibration.

18 Claims, 7 Drawing Sheets

VIBRATION DAMPENING BALL BAT

BACKGROUND OF THE INVENTION (a) Field of the Invention

The present invention relates to a ball bat with improved shock and vibration dampening. More particularly, the present invention relates to a ball bat with a handle, a barrel, and a socket assembly interposed between the handle and barrel. The socket assembly allows the barrel and handle to move relative to each other, which dampens shock and vibration.

(b) Description of the Prior Art

Baseball and softball are very popular sports in the United States, Japan, Cuba, and elsewhere. Ball bats and similar implements which impart or receive impact forces transmit the shock and vibrations of impact to the handle of the bat, causing the hands of the user to receive an uncomfortable or painful sensation. This sensation is more pronounced when the impact occurs on an area of the bat outside of the center of percussion or "sweet spot" of the bat.

The problem of this sensation being transferred to a user is well known in baseball. Fear of pain or discomfort may decrease the user's confidence and enthusiasm, impairing his or her performance in the sport. This problem is especially troublesome for individuals first learning the game or children.

Shock absorbing ball bats are known in the prior art, but each have their drawbacks. For example, a large number of parts and complex construction may make such ball bats more expensive than a conventional ball bat. For ball bats including composite materials, a complex shock absorbing system may require separate curing steps for different components of the ball bat. Other methods of producing shock absorbing ball bats may by applicable only to bats with metal barrels. Accordingly, what is needed is a simple, reliable, and cost-effective design that is effective in reducing the uncomfortable sensation produced by impact on the ball bat.

SUMMARY OF THE INVENTION

It is an object of the present invention to provide a novel design for a ball bat which decreases the shock and vibration resulting from an impact so as to minimize the discomfort of the user of the ball bat.

The present invention relates to a ball bat with improved shock and vibration dampening. More particularly, the present invention relates to a ball bat with a handle, a barrel, a notch, and a socket assembly adjacent to the notch and interposed between the handle and barrel. The socket assembly comprises a socket and a wedge. The inner surface of the barrel and outer surface of the handle are contoured to retain the generally toroidal socket. The socket includes a central channel sized to receive the handle. The socket allows the barrel and handle to move relative to each other, which dampens shock and vibration.

The wedge is located between the barrel and handle, restricting the relative movement between the handle and barrel when a ball is struck. The degree of restriction of relative movement between the handle and barrel can be varied by selecting the thickness of the wedge and the material from which the wedge is constructed. In some embodiments, the notch includes a ring disposed coaxially around the handle which acts cooperatively with the wedge to restrict the relative movement between the handle and barrel. In this embodiment, the notch may also include fill material, such that the barrel, ring, fill material, and handle, provide a substantially continuous and smooth exterior surface for the ball bat.

In one embodiment, the vibration dampening ball bat of the present invention comprises a barrel including a tapered end, a handle, a socket assembly interposed between the barrel and handle, the socket assembly including a socket and a wedge, whereby the barrel and handle are capable of moving relative to each other about the socket, the movement being restricted by the wedge. In this embodiment, the socket has a generally toroidal shape and includes a central channel, the wedge has a truncated generally conical shape and includes a small diameter end and a central channel, and the socket is attached to the small diameter end of the wedge, whereby the handle is serially positioned within the central channel of the socket and the central channel of the wedge.

In another embodiment, the vibration dampening ball bat of the present invention comprises a composite barrel including a tapered end, a composite handle, a socket assembly interposed between the barrel and handle, the socket assembly including a socket attached to a wedge, a notch located adjacent to the socket on a side opposite the wedge, and a ring positioned around the handle and located in the notch, whereby the barrel and handle are capable of moving relative to each other about the socket, the movement being cooperatively restricted by the wedge and ring.

In a further embodiment, the present invention comprises the method of making a vibration dampening ball bat, namely (a) providing a hollow composite barrel having a tapered end, the barrel being comprised of composite material, (b) providing a socket assembly, the socket assembly comprising a wedge having a large diameter end and a small diameter end and a socket attached to the small diameter end, (c) providing a hollow handle sized to fit within the socket assembly, (d) placing the socket assembly abut the barrel, such that the large diameter end is abut the tapered end, (e) drawing the tapered end over the socket assembly, and (f) inserting a portion of the handle into the socket assembly, whereby the barrel and handle are capable of moving relative to each other about the socket, the movement being restricted by the wedge. This embodiment may include the additional steps (g) creating a notch in the ball bat, the notch located at a longitudinal station adjacent to the socket on a side opposite the wedge, (h) positioning a ring around the handle, the ring located in the notch, whereby the ring restricts the movement between the barrel and handle in cooperation with the wedge, and (i) placing fill material in the notch, such that the barrel, ring, fill material, and handle, provide a substantially continuous and smooth exterior surface for the ball bat.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
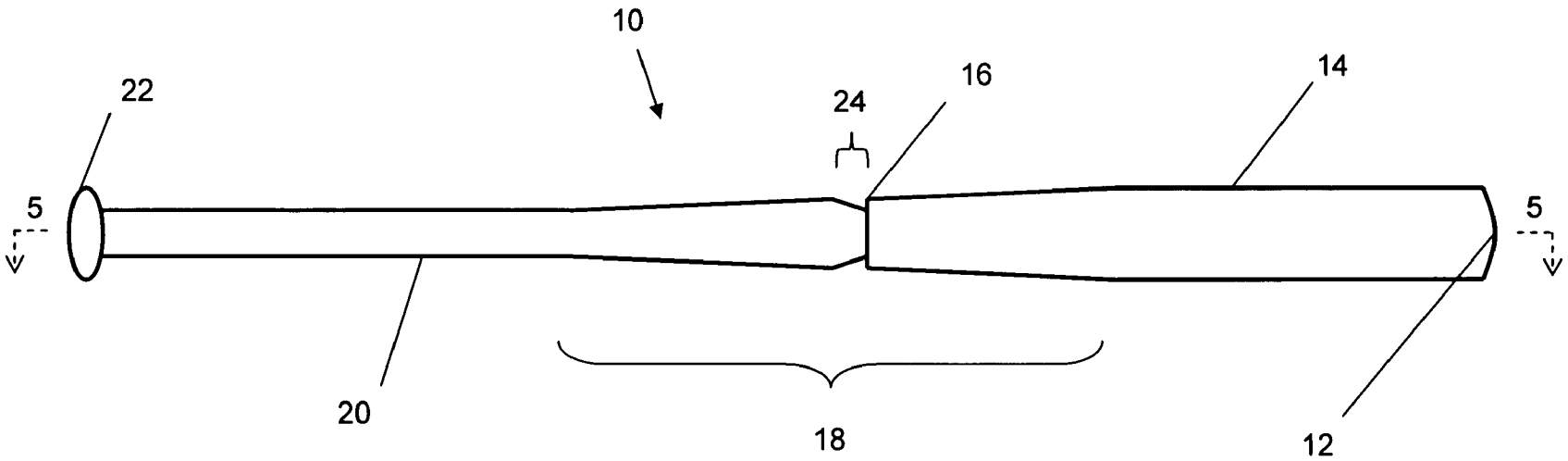
FIG. 1 depicts a first embodiment of a ball bat.
Figure 2C:
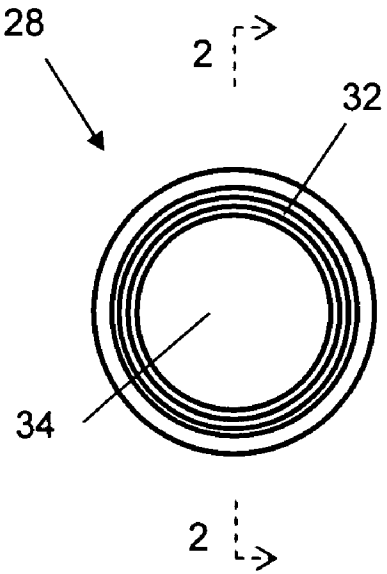
FIG. 2A-2C depict a knob-end view, a cross-sectional view along lines 2-2, and an end-end view of a socket.
Figure 2B:
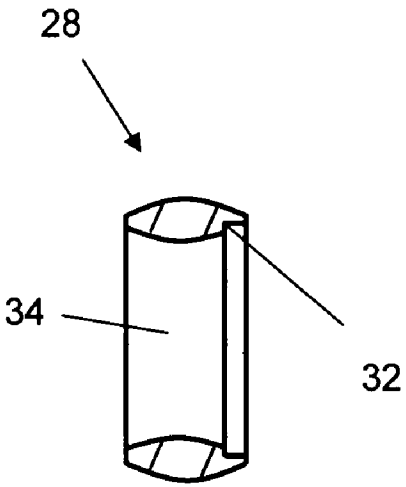
Figure 2A:
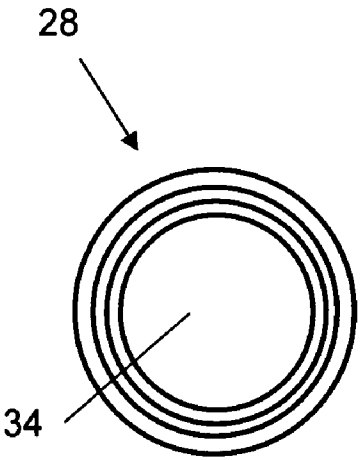
Figure 3C:
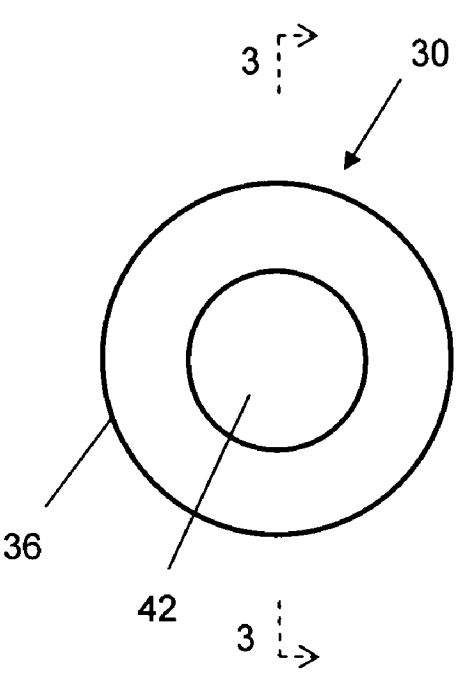
FIG. 3A-3C depict a knob-end view, a cross-sectional view along lines 3-3, and an end-end view of a wedge.
Figure 3B:
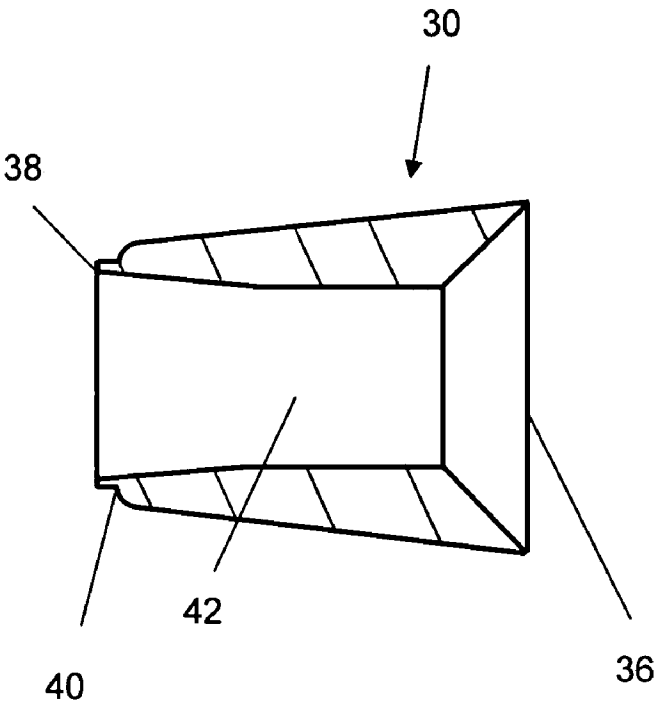
Figure 3A:
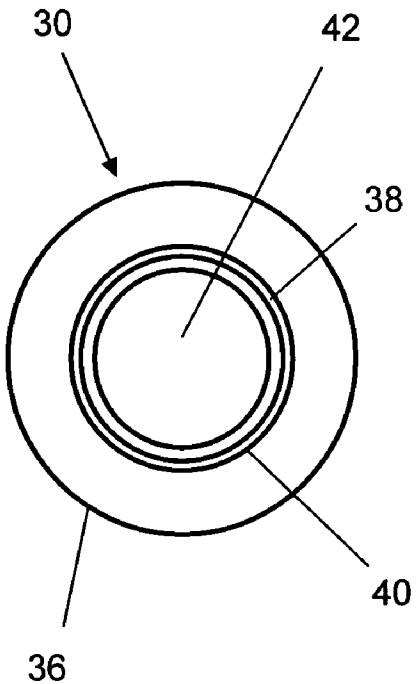

With reference to FIGS. 1-3, a first embodiment of the ball bat 10 of the present invention is shown having an end 12, a barrel 14 including a tapered end 16, a transition region 18, a handle 20, a knob 22, and a notch 24. A socket assembly 26 comprising a socket 28 and a wedge 30 is interposed between the barrel 14 and handle 20, adjacent to the notch 24.

As shown in FIGS. 2A, 2B, 2C, and 5, the socket 28 is pre-molded into a generally toroidal shape with a central channel 34 sized to snugly accept the handle 20. In one embodiment, the socket 28 has an outer diameter of about 1.25 inches (3.18 cm), an inner diameter of about 0.87 inches (2.29 cm), and a length of about 0.55 inches (1.40 cm). The outer curve of the socket 28 is a segment of a circle with a diameter of 1.26 inches (3.20 cm). The inner curve of the socket 28 is a segment of a circle with a diameter of 0.98 inches (2.49 cm). The height of the socket varies from about 0.19 inches (4.83 mm) at the center to about 0.07 inches (1.78 mm) at the edges. In a preferred embodiment, as shown in FIGS. 2B, 2C, 3, and 5, the socket 28 includes a notch 32. The notch 32 has a length of about 0.1 inches (2.54 mm) and a height of about 0.04 inches (1.02 mm). The socket 28 may be made of any suitable material, such as, for example, a hard nylon.

The wedge 30 is pre-molded into a truncated, generally conical shape having a large diameter end 36 and a small diameter end 38. The wedge 30 includes a central channel 42 sized to snugly accept the handle 20. In a preferred embodiment, as shown in FIGS. 3A, 3B, 3C, and 5, the wedge 30 includes a notch 40 located in the small diameter end 38. The length of the wedge 30 is about 2 inches (5.08 cm). The small diameter end 38 has a diameter of about 1.1 inches (2.79 cm). The diameter of the wedge 30 remains constant for a length of 0.1 inches (2.54 mm), defining the length of the notch 40, then increases along a curve with a radius of 0.05 inches (1.27 mm) to a diameter of 1.2 inches (3.05 cm). The diameter of the wedge 30 then increases at a 6.5 degree angle to a diameter of about 1.70 inches (4.32 cm) at the large diameter end 36. The central channel 42 has a 1 inch (2.54 cm) diameter at the small diameter end 38, which decreases in diameter at a 5 degree angle for a length of about 0.57 inches (1.45 cm) to a diameter of 0.9 inches (2.29 cm). The central channel 42 maintains a constant diameter of 0.9 inches (2.29 cm) for a length of about 1.08 inches (2.74 cm), then increases in diameter at a 45 degree angle for a length of about 0.35 inches (8.9 mm) to the large diameter end 36. In this embodiment, the outer surface of the wedge 30 corresponds with the inner surface of the transition region 18 of the ball bat 10. The wedge 30 may be made of any suitable material, such as, for example, rubber, or preferably, ethylene propylene diene monomer ("EPDM") rubber with a hardness between 40-50 Shore A, ideally about 45 Shore A.

Figure 4C:
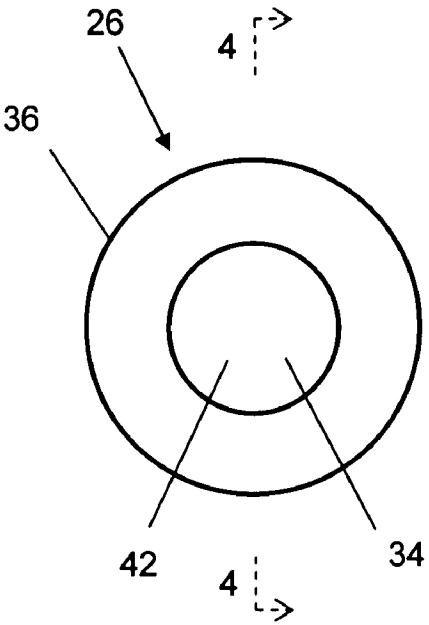
FIG. 4A-4C depict a knob-end view, a cross-sectional view along lines 4-4, and an end-end view of a socket assembly.
Figure 4B:
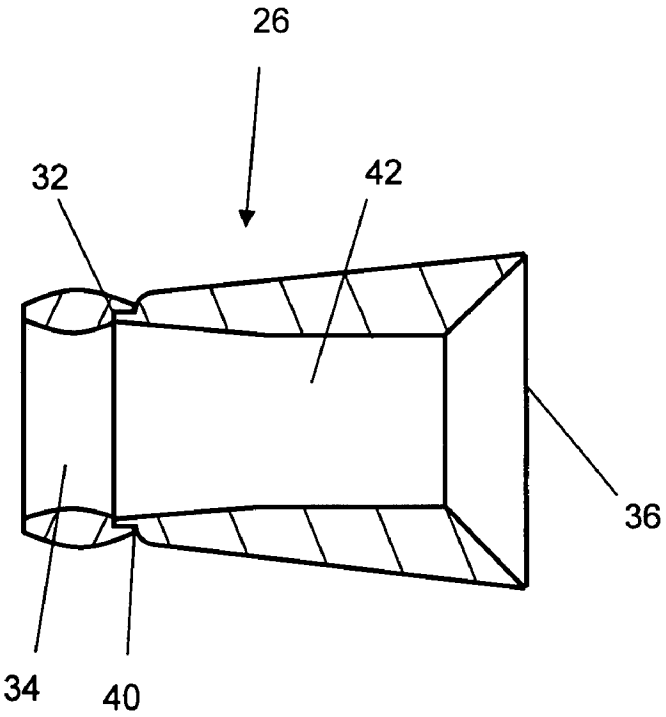
Figure 4A:
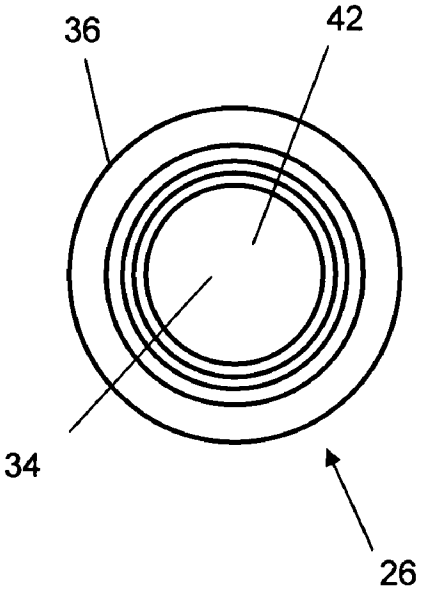
Figure 5:
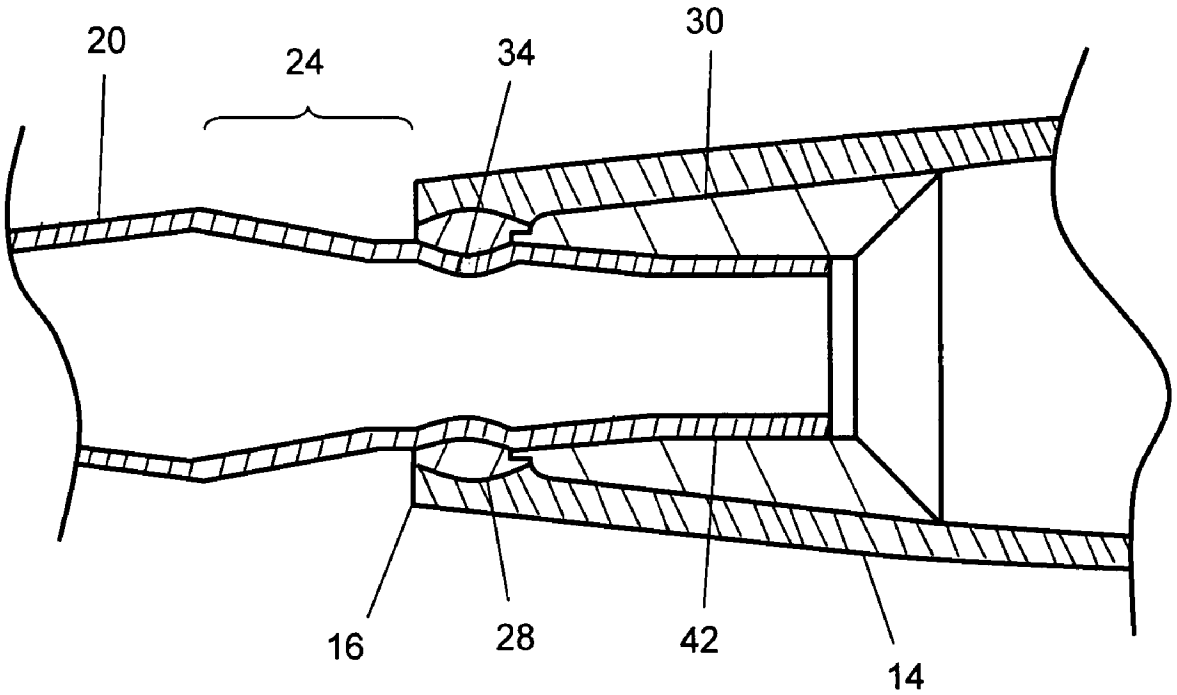
FIG. 5 depicts a cross-sectional view of the transition region of a first embodiment of a ball bat along lines 5-5 of FIG. 1.

The socket assembly 26 is made by attaching the socket 28 to the small diameter end 38 of the wedge 30 such that the handle 20 may serially fit inside the central channel 34 of the socket 28 and the central channel 42 of the wedge 30. As shown in FIGS. 4B and 5, the socket 28 contacts the wedge 30 such that the notch 40 of the wedge 30 is inserted within the notch 32 of the socket 28. The wedge 30 may be secured to the socket 28 by any suitable method, such as, for example bonding with an adhesive. In a preferred embodiment, the notch 32 of the socket and notch 40 of the wedge 30 are bonded together using a cyanoacrylate adhesive.

The handle 20 is a mostly constant diameter hollow tube. The handle 20 may be manufactured using common manufacturing techniques.

For example purposes only, a composite handle 20 may be made by rolling at least one flat sheet of pre-impregnated composite fiber ("pre-preg") around a mandrel, thereby making a tube with an outer diameter appropriately sized for a ball bat handle. In a preferred embodiment, the sheet of pre-preg comprises two layers of graphite pre-preg with fibers angled +/−15 degrees from the longitudinal with one layer orientated at a negative angle to the other layer. Two layers of pre-preg with a height of about 0.005 inches (0.127 mm) and fibers angled 90 degrees from the longitudinal are wrapped around the last 7.87 inches (20.0 cm) of the handle 20 at the end opposite the knob 22.

The barrel 14 is a mostly constant diameter hollow tube with a tapered end 16. In one embodiment, the barrel is made of composite material. The composite barrel may be manufactured using common manufacturing techniques.

For example purposes only, a composite barrel 14 may be manufactured by spirally rolling 24 layers of high aspect ratio parallelogram-shaped pieces of pre-preg, each layer having a height of about 0.005 inches (0.127 mm), on a rolling mandrel with the fibers oriented longitudinally, thereby making a tube with an outer diameter appropriately sized for a ball bat barrel. The parallelograms are rolled up such that each layer has a butt joint with itself and such that on one end all the layers stop at the same longitudinal station but on the other end, each layer is about one centimeter shorter than the previous layer, creating a tapered end 16. In one embodiment, the layers are angled +/−37 degrees from the longitudinal with each layer orientated at a negative angle to the previous layer.

A finishing mandrel includes a constant diameter section and a tapered section. After being rolled up, the barrel 14 is transferred to the constant diameter section of the finishing mandrel. The socket assembly 26 is temporarily attached to the finishing mandrel by affixing the large diameter end 36 of the wedge 30 to the end of the tapered section of the finishing mandrel. Latex banding about one inch (2.54 cm) wide and 0.05 inches (1.27 mm) high is wrapped around the tapered end 16 of the barrel 14. The tapered end 16 is then slowly drawn down the tapered section of the finishing mandrel, over the wedge 30 and over the socket 28, such that the tapered end 16 stops at the same longitudinal station as the socket 28. The latex banding is then removed and ribbons of pre-preg about 0.5 inches (1.27 cm) wide are wound around the lay-up directly above the socket assembly 26, forming a thickness of about 20 layers of pre-preg, each layer having a height of about 0.005 inches (0.127 mm). By being formed directly over the socket assembly 26, the inner surface of the barrel 14 is contoured to retain the socket assembly 26, as shown in FIG. 3.

The barrel 14 is removed from the finishing mandrel and a portion of the handle 20 is inserted. The handle 20 serially contacts the socket 28 and wedge 30 of the socket assembly 26, but does not contact the barrel 14, as shown in FIG. 5. The handle 20 is retained within the socket 28 and wedge 30 by mechanical interference. In some embodiments, the handle 20 may be attached to the wedge 30, such as, for example, by bonding with an adhesive. The barrel 14 and handle 20 are capable of moving relative to each other about the socket 28, which dampens shock and vibration. The wedge 30 is located between the barrel 14 and handle 20, restricting the relative movement between the handle 20 and barrel 14. The degree of restriction of relative movement between the handle 20 and barrel 14 can be controlled by selecting the thickness of the wedge 30 and the material from which the wedge 30 is constructed.

The exterior surfaces of the barrel 14 and handle 20 do not provide a substantially continuous and smooth surface for the outer surface of the transition region 18, as shown in FIGS. 1 and 5. Instead, a generally triangular shaped notch is formed in the transition region 18 of the ball bat 10. The notch 24 is perpendicular to the long axis of the ball bat 10 and formed at a station whereby the notch 24 is adjacent to the socket 28. The notch 24 has a maximum depth of about 0.25 inches (6.35 mm) adjacent to the socket 28, with the depth of the notch 24 decreasing in the direction of the knob 22. The notch 24 allows for greater relative movement between the handle 20 and the barrel 14.

An inflatable bladder is inserted into the ball bat 10 assembly and a standard knob 22 is applied using techniques common in the industry. The bladder is inflated, expanding the barrel 14 and handle 20. The expansion of the handle 20 causes the outer surface of the handle 20 to conform to the inner surface of the socket 28 and wedge 30, as shown in FIG. 5. In particular, the handle 20 forms a concave "saddle" shape conforming to the inner surface of the socket 28 which mechanically locks the handle 20 within the barrel 14. The assembly then is placed into a ball bat-shaped mold under pressure and heated to cure the ball bat, using standard techniques known in the art. Both the handle 20 and barrel 14 are cured at the same time, consequently only one composite cure cycle is needed for the ball bat 10. After curing, an end 12, such as a standard end cap, is applied using techniques common in the industry.

Figure 6:
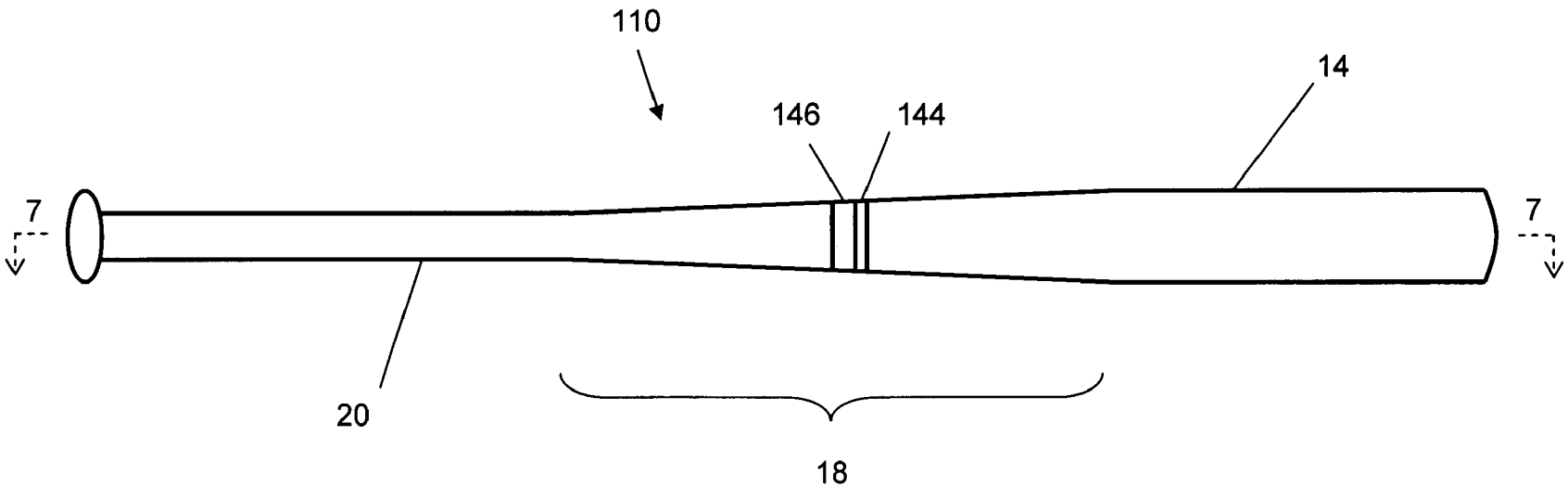
FIG. 6 depicts a second embodiment of a ball bat.
Figure 7:
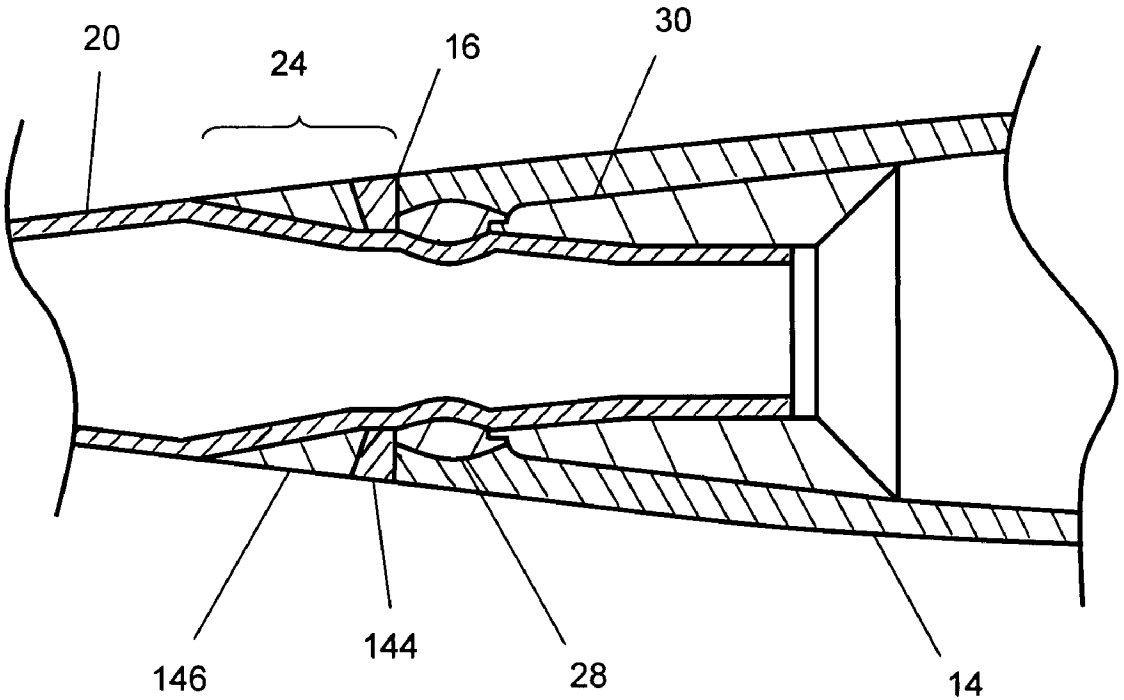
FIG. 7 depicts a cross-sectional view of the transition region of a second embodiment of a ball bat along line 7-7 of FIG. 6.

With reference to FIGS. 6-7, a preferred second embodiment of the ball bat 110 of the present invention is shown having a barrel 14 including a tapered end 16, a transition region 18, a handle 20, and a notch 24. A socket 28 and a wedge 30 are interposed between the barrel 14 and handle 120, adjacent to the notch 24.

This second embodiment of a ball bat 110 is constructed in a similar manner as the first embodiment of a ball bat 10, but further includes a ring 144 coaxially placed around the handle 20, in the notch 24, such that the ring 144 abuts the socket 28 and the tapered end 16 of the barrel 14. The height of the ring 144 is preferably equal to the depth of the notch 24 and the width of the ring is about 0.212 inches (5.38 mm). The ring 144 may be made of any suitable material, such as, for example, rubber, or preferably, EPDM rubber with a hardness between 40-50 Shore A, ideally about 45 Shore A. The ring 144 is preferably constructed from the same material as the wedge 30. The ring 144 acts cooperatively with the wedge 30 to restrict the relative movement between the handle 20 and barrel 14 about the socket 28. The degree of restriction of relative movement between the handle 20 and barrel 14 can be controlled by modifying the material from which the ring 144 is constructed. The remaining volume of the notch 24 may be filled with a fill material 146, such as, for example, adding sufficient pre-preg to fill the remaining volume of the notch 24 before the cure cycle. In this preferred second embodiment, the notch 24 is filled by the ring 132 and fill material 146 such that the barrel 14, ring 144, fill material 146, and handle 20, provide a substantially continuous and smooth exterior surface for the transition region 18 of the ball bat 110, as shown in FIGS. 6 and 7.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A ball bat comprising:
a barrel including a tapered end;
a handle including an inserted portion and a portion graspable by a user;
a socket assembly interposed between said barrel and said handle, said socket assembly including:
a socket including a central channel; and
a wedge including a central channel;
whereby said inserted portion of said handle is serially positioned within said central channel of said socket and said central channel of said wedge;
wherein an outer surface of said inserted portion of said handle has a concave shape corresponding to an inner surface of said socket; and
whereby said barrel and said handle are capable of moving relative to each other about said socket, said movement restricted by said wedge.

2. The ball bat of claim 1, further comprising a notch located adjacent to said socket on a side opposite said wedge.

3. The ball bat of claim 2, further comprising a ring positioned around said handle and located in said notch, such that said ring restricts said movement in cooperation with said wedge.

4. The ball bat of claim 3, further comprising fill material located in said notch such that said barrel, ring, fill material, and handle, provide a substantially continuous and smooth surface exterior surface for said ball bat.

5. The ball bat of claim 1, wherein:
said socket has a generally toroidal shape;
said wedge has a truncated generally conical shape and includes a small diameter end; and
said socket is attached to said small diameter end.

6. The ball bat of claim 5, wherein:
said small diameter end of said wedge includes a notch;
said socket includes a notch;
whereby said socket contacts said wedge such that said notch of said wedge is inserted within said notch of said socket.

7. The ball bat of claim 1, wherein said barrel and said handle are comprised of composite material.

8. The ball bat of claim 1, wherein said wedge is attached to said handle.

9. The ball bat of claim 1, wherein said socket assembly is positioned entirely within said barrel.

10. The ball bat of claim 1, wherein said inserted portion of said handle is integral to said portion of said handle graspable by said user.

11. The ball bat of claim 1, wherein said handle is unitary.

12. A ball bat comprising:
a barrel including a tapered end;
a handle including an inserted portion and a portion graspable by a user;
a socket assembly interposed between said barrel and said handle, said socket assembly including a socket attached to a wedge, said socket including a central channel and said wedge including a central channel;
a notch located adjacent to said socket on a side opposite said wedge; and
a ring positioned around said handle and located in said notch, whereby said barrel and said handle are capable of moving relative to each other about said socket, said movement cooperatively restricted by said wedge and said ring;

whereby said inserted portion of said handle is serially positioned within said central channel of said socket and said central channel of said wedge, and wherein an outer surface of said inserted portion of said handle has a concave shape corresponding to an inner surface of said socket.

13. A method for making a ball bat, comprising the steps of:

a) providing a hollow barrel having a tapered end, said barrel comprised of composite material;

b) providing a socket assembly, said socket assembly comprising a wedge having a large diameter end and a small diameter end and a socket attached to said small diameter end;

c) providing a hollow handle having an inserted portion sized to fit within said socket assembly;

d) placing said socket assembly abut said barrel, such that said large diameter end is abut said tapered end;

e) drawing said tapered end over said socket assembly;

f) inserting said inserted portion of said hollow handle into said socket assembly and expanding said handle to form a concave shape in said inserted portion of said handle corresponding to said inner surface of said socket assembly, whereby said barrel and said handle are capable of moving relative to each other about said socket, said movement restricted by said wedge.

14. The method for making a ball bat of claim 13, wherein drawing said tapered end of step e) further comprises layering additional composite material to said barrel atop said socket and said wedge.

15. The method for making a ball bat of claim 13, further comprising the additional step of:

g) creating a notch in said ball bat, said notch located at a longitudinal station adjacent to said socket on a side opposite said wedge.

16. The method for making a ball bat of claim 15, further comprising the additional step of:

h) positioning a ring around said handle, said ring located in said notch, whereby said ring restricts said movement in cooperation with said wedge.

17. The method for making a ball bat of claim 16, further comprising the additional step of:

i) placing fill material in said notch, such that said barrel, ring, fill material, and handle, provide a substantially continuous and smooth exterior surface for said ball bat.

18. A ball bat comprising:

a barrel including a tapered end;

a handle including an inserted portion and a portion graspable by a user;

a socket assembly interposed between said barrel and said handle, said socket assembly including:

a socket having a generally toroidal shape and including a central channel and a notch;

a wedge having a truncated generally conical shape and including a central channel and a small diameter end, said small diameter end including a notch;

whereby said inserted portion of said handle is serially positioned within said central channel of said socket and said central channel of said wedge;

whereby said barrel and said handle are capable of moving relative to each other about said socket, said movement restricted by said wedge; and whereby said socket contacts said small diameter end of said wedge such that said notch of said wedge contacts said notch of said socket.

* * * * *